US005647183A

United States Patent [19]

Counihan

[11] Patent Number: 5,647,183

[45] Date of Patent: Jul. 15, 1997

[54] RESILIENT FLOORING

[76] Inventor: James Counihan, 50 Griffin Mill Rd., Piedmont, S.C. 29673

[21] Appl. No.: 693,661

[22] Filed: Aug. 9, 1996

[51] Int. Cl.[6] ..... E04F 15/22

[52] U.S. Cl. ..... 52/403.1; 52/480; 52/551; 52/506.1; 52/506.05

[58] Field of Search ..... 52/403.1, 480, 52/550, 551, 506.05, 506.1

[56] References Cited

U.S. PATENT DOCUMENTS

| | | | |
|---|---|---|---|
| 1,342,610 | 6/1920 | Wheeler . | |
| 3,387,422 | 6/1968 | Wanzer . | |
| 4,314,428 | 2/1982 | Bromwen | 52/480 X |
| 4,759,164 | 7/1988 | Abendroth et al. | 52/480 X |
| 4,819,932 | 4/1989 | Trotter, Jr. | 52/480 X |
| 4,856,250 | 8/1989 | Gronau | 52/480 |
| 5,016,413 | 5/1991 | Counihan | 52/391 |
| 5,253,464 | 10/1993 | Nilsen | 52/480 X |
| 5,497,590 | 3/1996 | Counihan | 52/391 |
| 5,540,025 | 7/1996 | Takehara et al. | 52/403.1 |

*Primary Examiner*—Carl D. Friedman
*Assistant Examiner*—Yvonne Horton-Richardson
*Attorney, Agent, or Firm*—Henry S. Jaudon; Cort Flint

[57] ABSTRACT

A resilient base flooring for assembly on a base surface comprising a plurality of subfloor panels carried above the base surface in substantial side-by-side and end-to-end arrangement to form a base floor having a continuous uninterrupted surface. A plurality of flooring boards are arranged to extend transversely of and are received with the sub-floor panels to define integral flooring system. Resilient members are disposed between the subfloor panels and the base surface to provide resilient support for the integral flooring. A first limit bar is connected with the base surface and a second limit bar is connected with an inner surface of the subfloor panels. The limit bars have overlying edges which interact to limit vertical movement of the integral flooring.

20 Claims, 2 Drawing Sheets

RESILIENT FLOORING

BACKGROUND OF THE INVENTION

The present invention relates to a resilient flooring system for gymnasiums and like areas.

Prior resilient flooring systems are known which provide resiliency for athletic activities such as aerobics, gymnastics and the like. U.S. Pat. No. 5,016,413, to the same inventor, is an example of a known system in which resiliency is achieved by providing a resilient covering over the base floor and supporting sub-floor sections in place over the resilient covering. The sub-floor sections are secured with the base floor by means of channel members which have oppositely extending upper flanges which engage over the edge surface of the sub-floor sections. The channel members are secured with the base floor by nails.

It has been found that an uneven sound or feel is created when pressure is applied to the flooring surface directly over one of the slots created between the spaced ends of the subfloor panels such as formed in the arrangement of the above referred to U.S. Patent. Also when the braids or nails used to secure the finished flooring with the sub-flooring pass into one of the slots there is nothing there for them to engage with. This creates a situation where, over time, they may work their way out and extend above the finished surface. This of course is unacceptable.

Accordingly, it is an object of the present invention to provide a resilient flooring system which may be easily and quickly installed.

Another object of the present invention is to provide a resilient flooring system which comprises substantially continuous subfloor surface.

Another object of the present invention is to provide a resilient flooring which removes high and low spots present in the base floor.

Another object of the invention is a resilient flooring with no dead spots.

Another object of the invention is to provide a flooring system with a subfloor to which the finished flooring is evenly secured.

SUMMARY OF THE INVENTION

The above objectives are accomplished according to the present invention by providing a resilient flooring system for assembly on a base surface. The system includes a plurality of subfloor panels having upper and lower surfaces arranged to generally co-extend over the base surface in side-by-side relationship. There are a plurality of resilient members arranged over the base surface upon which the panels are supported.

Each panel includes a pair of end portions. Each end portion is formed to include an upper or lower edge spaced therefrom and forming a lower and an upper ledge respectively. The upper ledge is located to have its upper surface co-extend with the upper surface of the panel while the lower ledge is located to have its lower surface co-extend with the lower surface of the subfloor panel.

The end portions of the subfloor panel are arranged to be generally end to end with the upper and lower ledges in over lapping relationship forming a substantially uninterrupted subfloor surface over the base surface.

A limit member is secured within the channel. The limit member functions to allow limited vertical movement of the flooring system.

The resilient members may comprise spaced strips or spaced individual pads.

The panels preferably comprise an upper and a lower plywood sheet secured together one on the other. The lower sheet is preferably thicker than the upper sheet being ¾" plywood while the upper sheet is preferably ¼" plywood. The lower sheet is also shorter or of less length than the upper sheet.

In use, the sheets are arranged one over the other with one end of the upper sheet overhanging the end of the lower sheet forming a ledge while at the opposite end the lower sheet extends beyond the upper sheet forming a second ledge. This creates upper and lower ledges. Because the lower sheet is shorter, the upper ledge is longer than the lower ledge.

The limit member comprises first and second limit bars. The first limit bar is secured with the lower plywood sheet while the second limit bar is secured to the base surface. Each limit bar is provided with an extension. The extension of the lower limit bar extends above the extension of the upper limit bar and act to limit vertical movement of the flooring system. The extensions may be covered with padding members.

A resilient base flooring for assembly on a base surface comprising a plurality of subfloor panels carried above the base surface in substantial side-by-side and end-to-end arrangement to form a base floor having a continuous uninterrupted surface. A plurality of flooring boards are arranged to extend transversely of the sub-floor panels to define a floor are secured therewith by suitable securing members forming an integral flooring system.

Resilient members are disposed between the subfloor panels and provide the basis for the resilient support for the integral flooring. A first limit bar is connected with the base surface and transversely of the subfloor panels. A second limit bar is connected with an inner surface of the subfloor panels and also extends transversely of the subfloor panels. The limit bars have overlying edges which interact to limit vertical movement of the integral flooring.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
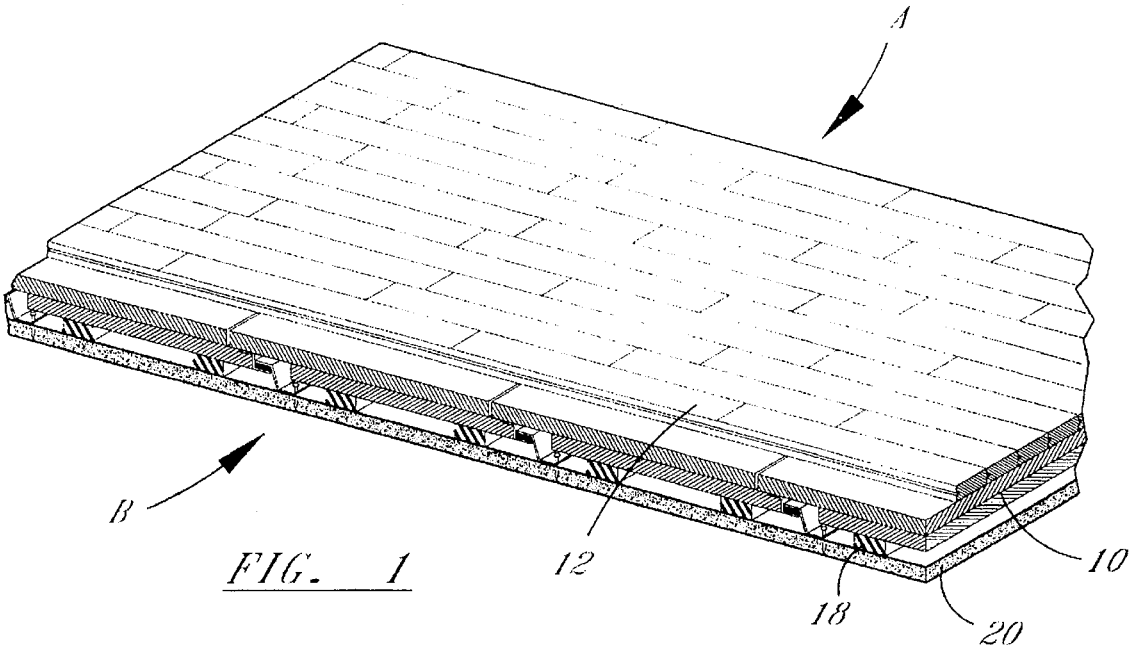
FIG. 1 is a sectional plane view of the resilient flooring system of the invention.

Turning to the drawings, FIG. 1, flooring system A of the invention is shown attached with base floor 20. System A includes flooring boards 12 secured with sub-flooring 10, comprised of sub-flooring panels 16, by usual means such as brads 14 or nails (not shown). Sub-flooring panels 16 are supported by foam strips or pads 18 which are separated from base floor 20 by plastic sheets 22. Foam strips or pads 18 may be spaced as shown, may be equal size of panels 16 or individually arranged foam members.

Figure 2:
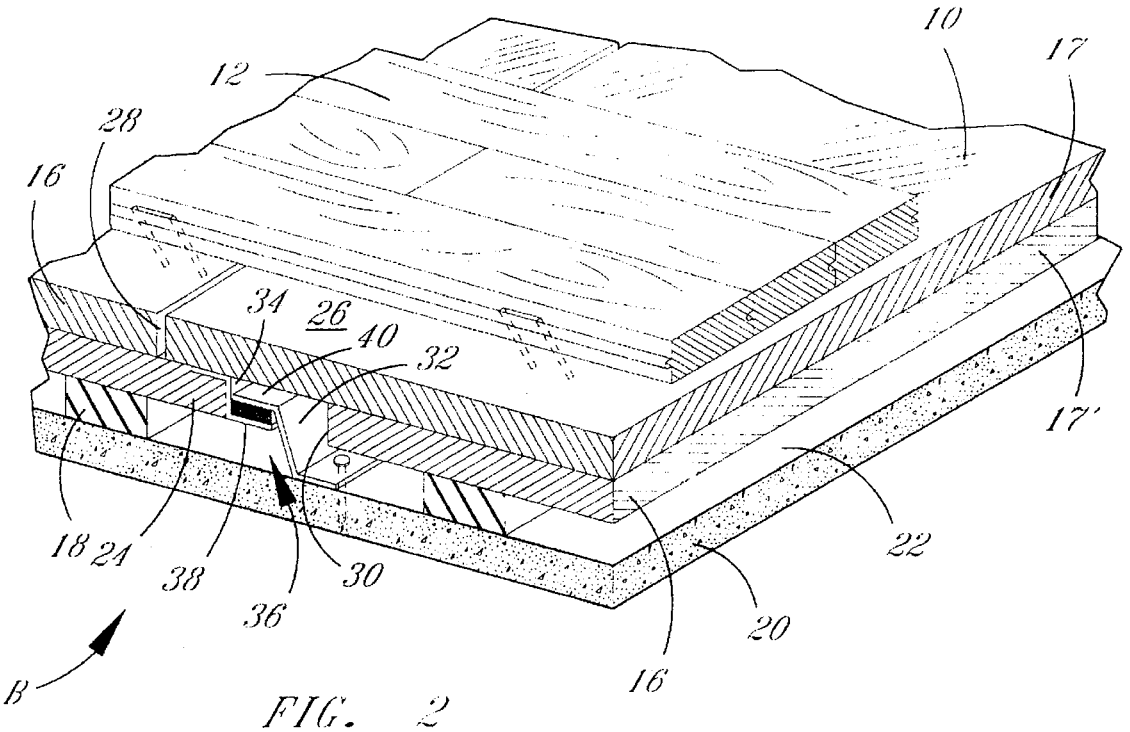
FIG. 2 is a sectional perspective view of the floor securing structure for the resilient flooring system of the invention.
Figure 3:
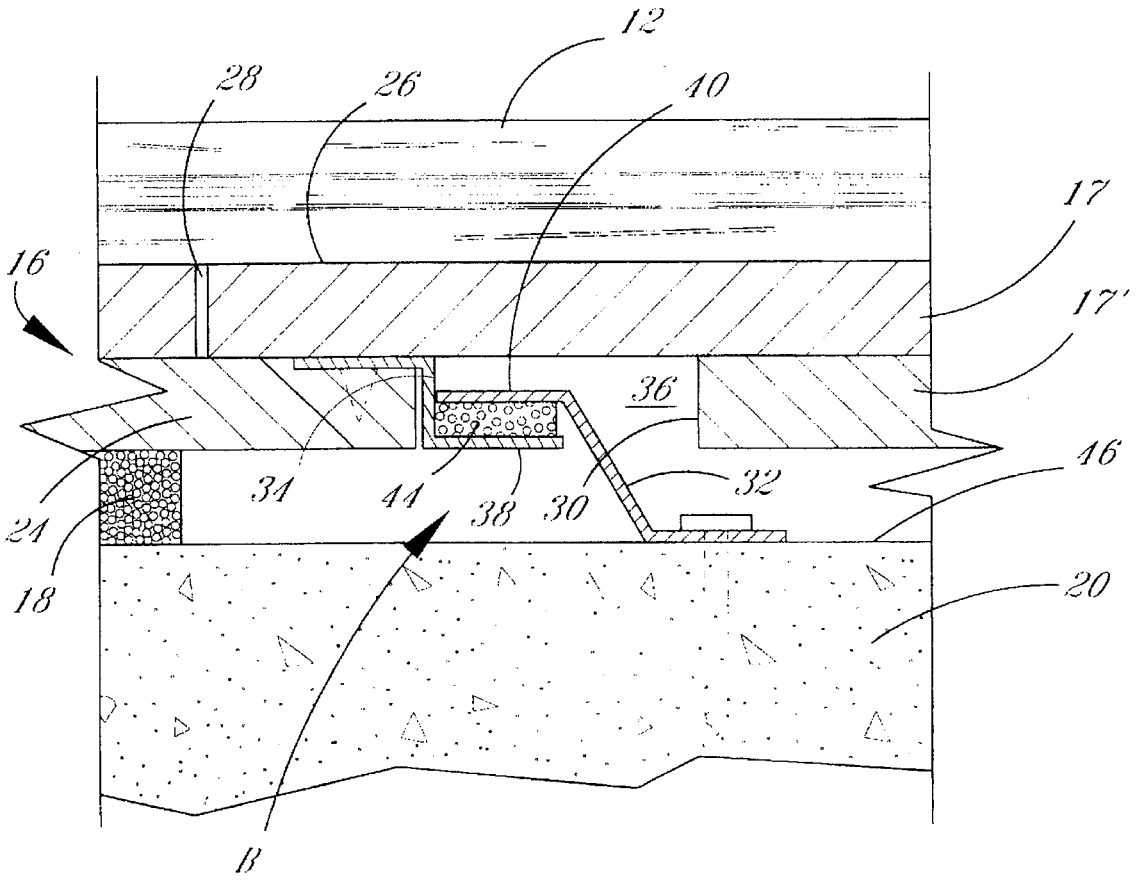
FIG. 3 is a sectional enlarged side view of the flooring system of FIG. 2.

As best shown in FIGS. 2 and 3, the sub-flooring system of flooring system A includes a plurality individual panels 16 arranged over base floor 20 in a generally side-by-side manner. Each panel which is generally 2'×4' may be one inch plywood, it may be two one half inch plywood sheets 17, 17' secured together or it may be one and one-fourth inch plywood sheet secured with a three-fourths inch plywood sheet. In the latter arrangement the thicker sheet is on the bottom.

Each end of the plywood panels 16 is formed to have a lower ledge 24 and an upper ledge 26 extending from an inner edge 28 or 30. Lower and upper Ledges 24, 26 are arranged so that the upper surface upper ledges 26 extends along the plane of the upper surface of panel 16. A lower ledge 24 is formed at the opposite end of panel 16 and opposite upper ledge 26 to have a lower surface extend along the plane of the opposite surface of panel 16. Ledges 24,26 are formed to extend from inner edges 28, 30 formed to connect with the upper or lower surfaces of panels 16. The lower ledges 24 are about one or two inches shorter than the upper leges 26. This allows upper ledges 26 to overlay completely lower ledge 24 and engage with edge 28 as shown in FIG. 3 when sub-flooring panels 16 are positioned to form subfloor 10. Lower ledge 30 is located in spaced position from lower edge 24 by approximately 1" to 1.5" forming grove 36 beneath the lower surface of upper ledge 26.

A securing member B formed of a pair of substantially Z shaped bars 32, 34. Bars 32, 34 are provided with oppositely extending edges 38, 40 which are designed to overlay one another.

An extension of bar 32 is secured with base surface 20 by nails or other suitable members. Edge 40 of bar 32 extends into and along groove 36. Bar 34 is secured with the upper surface of ledge 24 and with its edge 38 located within and along groove 36 in a position vertically below edge 38 as shown. Edges 38 and 40 may be separated with resilient pad 44.

Flooring system A is assembled over base floor 20 in the following manner.

A plastic sheet 46 is placed over the base floor to hold moisture away from the flooring system. Resilient pads 18 are placed over the plastic sheet in a spaced and generally parallel arrangement over the entire base floor.

Sub floor panels 16 are placed over elastic pads 18 in general side by side arrangement. Opposed ends of panels 16 at upper ledges 26 are placed in substantial end to end contact forming subfloor 10 with a substantially continuous upper surface. Groove 36 is formed in the space between the ends of panels 16 at lower ledges 24 as clearly shown in FIG. 3. The groove is created by the difference in length between the upper and lower plywood sheets 17, 17' forming panels 16 and the fact that the lower sheet is secured in a slightly off-centered position relative to the upper sheet.

Securing member B, comprising bars 32, 34, is arranged within groove 36. Securing member 34 is connected with the upper surface of lower ledge or shelf 24 with its edge 38 extending into groove 36. Securing element 32 is secured with the base floor 20 by nails or other suitable members with its edge 40 disposed in groove 36 and above edge 38. This arrangement allows the flooring system to move slightly vertically downward when weight is applied and foam members 18 are compressed. Removal of the weight allows members 18 to expand and move the subfloor vertically upward. This movement is limited by securing member B.

Strip flooring 12 is placed over and secured with the subfloor 10 by usual means such as nails or beads. When attached, the strip or finished flooring 12 and the sub-flooring panels 16 form a unitary flooring surface. Because of the elasticity of the foam pads 18, the flooring system A adjusts to eliminate slight uneven spots which may be in the base floor.

While a preferred embodiment of the invention has been described using specific terms, such description is for illustrative purposes only, and it is to be understood that changes and variations may be made without departing from the spirit or scope of the following claims.

What is claimed is:

1. A resilient flooring system for assembly on a base surface to provide a resilient floor comprising:

a plurality of subfloor panels having upper and lower surfaces, said panels being arranged to generally co-extend over said base surface in side-by-side relationship;

a plurality of resilient members arranged over said base surface, said resilient members supporting said panel members;

ends of said panels include upper and lower edges each forming a ledge, said ledges being formed on opposite ends of said upper and lower surfaces of said panels;

said panels being arranged end to end with said ledges overlaying one another to form a substantially continuous upper surface, the end of the ledge appearing on said lower surface of said panel being spaced from said adjacent panel end sufficiently to form a channel opening onto said base surface;

a limit member located within said channel and connected with said panels and said base surface, said limit member functioning to allow limited vertical movement of said flooring system; and exterior flooring secured with said upper surface of said sub-flooring panels.

2. The flooring system of claim 1 wherein said resilient members comprise pads arranged to be substantially side-by-side and end-to-end over said base surface.

3. The flooring system of claim 1 wherein said resilient members comprise spaced strips.

4. The flooring system of claim 1 wherein said resilient members comprise spaced pads.

5. The flooring system of claim 1 wherein said panels comprise at least an upper and a lower plywood sheet secured together one above the other.

6. The flooring system of claim 5 wherein the lower of said sheets is thicker than the upper of said sheets.

7. The flooring system of claim 5 wherein said lower sheet is ¾" plywood.

8. The flooring system of claim 5 wherein said lower sheet is shorter than said upper sheet.

9. The flooring system of claim 8 wherein said sheets are arranged one over the other with an end of said upper sheet extending beyond the corresponding end of said lower sheet creating said upper and lower ledges at opposed ends of said panel.

10. The flooring system of claim 5 wherein said limit member comprises first and second limit bars, said first limit bar being secured with said lower plywood sheet and said second limit bar being secured to said base surface.

11. The flooring system of claim 10 wherein a portion of said lower limit bar extends above a portion of said upper limit bar to restrict vertical movement of said flooring system.

12. The flooring system of claim 11 wherein padding members are carried by at least one of said portions.

13. The flooring system of claim 1 wherein said limit member comprises first and second limit bars each having an engaging portion extending into said channel, said first limit bar being secured with said base surface and said second limit bar being secured with said sub-flooring.

14. A resilient base flooring for assembly on a base surface comprising:

a plurality of subfloor panels carried above said base surface in substantial side-by-side and end-to-end arrangement to form a base floor having a continuous and substantially uninterrupted surface;

a plurality of flooring boards extending transversely of said sub-floor panels to define a floor and securing members securing said flooring boards with said sub-floor panels forming integral flooring;

resilient members disposed between said subfloor panels and said base floor to provide resilient support for said integral flooring;

a first limit bar connected with said base floor and extending transversely of said subfloor panels;

a second limit bar connected with an inner surface of said subfloor panels and extending transversely of said subfloor panels;

said first and second limit bars having overlying edges which interact to limit vertical movement of said integral flooring.

15. The flooring system of claim 14 wherein said subfloor panels comprise an upper and lower wooden sheet secured together one above the other and offset in one direction forming protruding upper and lower extensions at opposite ends.

16. The flooring systems of claim 15 wherein said lower sheet is of less length than said upper sheet forming said upper extensions of greater length than said lower extensions.

17. The flooring system of claim 16 including slots formed between opposing ends of said lower sheets, said overlying edges of said limit bars being locating with said slots.

18. The flooring system of claim 17 including securing members connecting said second limit bar with said lower sheet.

19. The flooring system of claim 15 wherein at least the lower wooden sheet is plywood.

20. The flooring systems of claim 15 wherein the lower wooden sheet is of greater thickness than said upper wood sheet.

* * * * *